US008979248B2

(12) United States Patent
Yamamoto et al.

(10) Patent No.: US 8,979,248 B2
(45) Date of Patent: Mar. 17, 2015

(54) INK-JET APPARATUS

(71) Applicant: Panasonic Corporation, Kadomi-shi, Osaka (JP)

(72) Inventors: Kenichi Yamamoto, Osaka (JP); Hidehiro Yoshida, Osaka (JP); Teiichi Kimura, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 14/337,838

(22) Filed: Jul. 22, 2014

(65) Prior Publication Data

US 2015/0022589 A1 Jan. 22, 2015

(51) Int. Cl.
*B41J 2/14* (2006.01)
*B41J 2/145* (2006.01)

(52) U.S. Cl.
CPC ..... *B41J 2/145* (2013.01)
USPC ..... 347/49

(58) Field of Classification Search
CPC ..... B41J 2/145; B41J 3/543; B41J 2/155; B41J 2202/20; B41J 2202/19; B41J 2202/21
USPC ..... 347/20, 40, 42, 49, 54, 68
See application file for complete search history.

(56) References Cited

U.S. PATENT DOCUMENTS 7,278,707 B2 * 10/2007 Silverbrook ..... 347/49
7,946,684 B2 * 5/2011 Drury et al. ..... 347/49
8,449,071 B2 * 5/2013 Saito ..... 347/40

FOREIGN PATENT DOCUMENTS

JP 2002-228822 8/2002

* cited by examiner

*Primary Examiner* — An Do
(74) *Attorney, Agent, or Firm* — Hamre, Schumann, Mueller & Larson, P.C.

(57) ABSTRACT

A plurality of ink-jet heads are displaced over time on a line scan head loaded with the ink-jet heads, leading to lower printing accuracy. A plurality of uneven portions are formed in parallel with a print-scan direction on the faying surfaces of the ink-jet heads and a head plate loaded with the ink-jet heads, allowing a displacement made over time after positioning to be guided in the print-scan direction. This can suppress a displacement in a direction orthogonal to the print-scan direction, achieving an ink-jet apparatus that can keep high printing accuracy using this solution.

8 Claims, 7 Drawing Sheets

INK-JET APPARATUS

FIELD OF THE INVENTION

The present invention relates to an ink-jet apparatus.

BACKGROUND OF THE INVENTION

In recent years, methods for manufacturing imaging devices using ink-jet apparatuses have been attracting attention. FIGS. 8(A) and 8(B) are plan views of a typical ink-jet apparatus.

As shown in FIGS. 8(A) and 8(B), the ink-jet apparatus includes a pedestal 41, a substrate transport stage 42, a gate-like gantry 43, and a line scan head 50.

As shown in FIGS. 8(A) and 8(B), the substrate transport stage 42 relatively moves. Ink is properly discharged from the line scan head 50 during the movement and is applied to a coating area 44 of a substrate 10 placed on the substrate transport stage 42, printing the substrate 10.

FIG. 9 is a schematic diagram of the line scan head 50. As shown in FIG. 9, the line scan head 50 includes a plurality of ink-jet heads 51 and a casing 52 that holds the ink-jet heads 51. The ink-jet heads 51 are arranged in a direction orthogonal to the print-scan direction of a substrate, the ink-jet heads 51 being so wide as to print the substrate in one printing/scanning operation. The line scan head 50 includes ink supply pipes 53 that supply ink for printing from the outside.

A feature of an ink-jet apparatus is to inexpensively manufacture devices with a simple manufacturing process. In an ink-jet apparatus provided with the line scan head having the arranged ink-jet heads 51, however, the positions of the ink-jet heads 51 are hard to stabilize, making it difficult to form fine-pitch patterns on a substrate.

In order to overcome this drawback, the line scan head 50 is devised to actively correct the displacements of the ink-jet heads 51 (Japanese Patent Laid-Open No. 2002-228822).

FIGS. 10(A) and 10(B) are schematic diagrams showing the configuration of the conventional line scan head 50 described in Japanese Patent Laid-Open No. 2002-228822. FIG. 10(A) is a side view and FIG. 10(B) is a perspective view.

Ink-jet heads 301, 302, and 303 are fixed to a reference base 321 and stages 322 and 323 via ink-jet head fixing members 311, 312, and 313 shown in FIG. 10(B). The stages 322 and 323 are fixed to the reference base 321 via piezoelectric elements 341 and 342 acting as actuators.

When the ink-jet heads 301 and 303 are displaced relative to the ink-jet head 302, the piezoelectric elements 341 and 342 are driven by a desired displacement so as to be corrected to design locations.

In the conventional configuration, however, the piezoelectric elements acting as actuators need to be operated to fix the positions of the ink-jet heads. Thus, the ink-jet heads cannot be disposed close to each other with a high density, making it difficult to dispose the ink-jet heads.

If the ink-jet heads are disposed in the conventional configuration, the ink-jet heads are sequentially disposed through a predetermined actuator mechanism, increasing spacing between the ink-jet heads. Thus, the line scan head and the ink-jet apparatus including the line scan head increase in size.

This may cause a time difference before the application of ink depending on the installation positions of the ink-jet heads, in substrate scanning for printing. The time difference leads to uneven drying, considerably deteriorating printing quality.

Moreover, the actuators need to be always driven in order to keep the positions of the ink-jet heads disposed on the line scan head, disadvantageously causing higher power consumption and heat generation.

The line scan head containing a heat source, in particular, may reduce the accuracy of component assembly. Furthermore, once power is shut down for maintenance of apparatuses, the kept positions of the ink-jet heads are reset, disadvantageously reducing positional repeatability.

An object of the present invention is to provide an ink-jet apparatus including a small line scan head with densely mounted ink-jet heads, which guarantees the positions of the ink-jet heads for a long period to solve the conventional problems.

DISCLOSURE OF THE INVENTION

In order to attain the object, an ink-jet apparatus according to the present invention is an ink-jet apparatus including a plurality of ink-jet heads, a plate loaded with the ink-jet heads, and a fixing member that fixes the ink-jet heads and the plate, wherein the plate and the ink-jet head have faying surfaces, one faying surface has a plurality of long thin concaves, the other faying surface has a plurality of long thin convexes entered into at least one of the long thin concaves, and the width of a region containing the long thin concaves in a direction orthogonal to the length direction of the long thin concaves is not smaller than the width of a region containing the long thin convexes on the faying surfaces in a direction orthogonal to the length direction of the long thin convexes.

As has been discussed, according to the present invention, the ink-jet heads can be densely placed at guaranteed positions, achieving printing with high precision and high definition for a long period of time.

DESCRIPTION OF THE EMBODIMENTS

An embodiment of the present invention will be described below with reference to the accompanying drawings.

First Embodiment

Figure 1A:
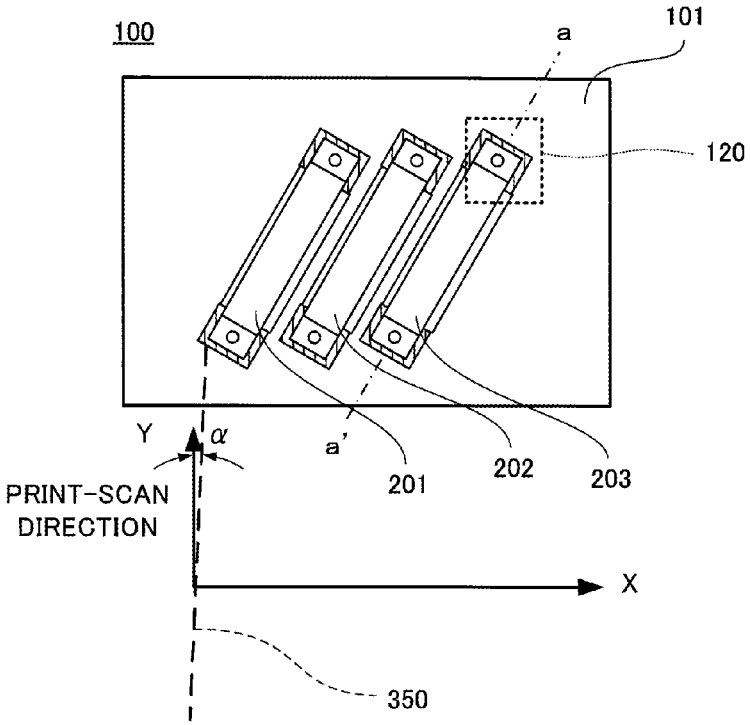
FIG. 1(A) is a schematic diagram showing the structure of an ink-jet apparatus according to a first embodiment of the present invention.

FIG. 1(A) is a schematic diagram showing a state of a line scan head 100 viewed from a nozzle surface, that is, an ink discharge surface according to a first embodiment of the present invention. The line scan head 100 in FIG. 1(A) includes ink-jet heads 201, 202, and 203.

The ink-jet heads are sequentially disposed in parallel and at regular intervals on a head plate 101 in a direction orthogonal to a print-scan direction (X-axis direction in FIG. 1(A)) so as to be inclined with respect to the print-scan direction along which the line scan head 100 and a substrate move relative to each other (Y-axis direction in FIG. 1(A)).

The head plate 101 has tapped holes for fixing the ink-jet heads 201, 202, and 203 placed on the head plate 101.

Figure 9:
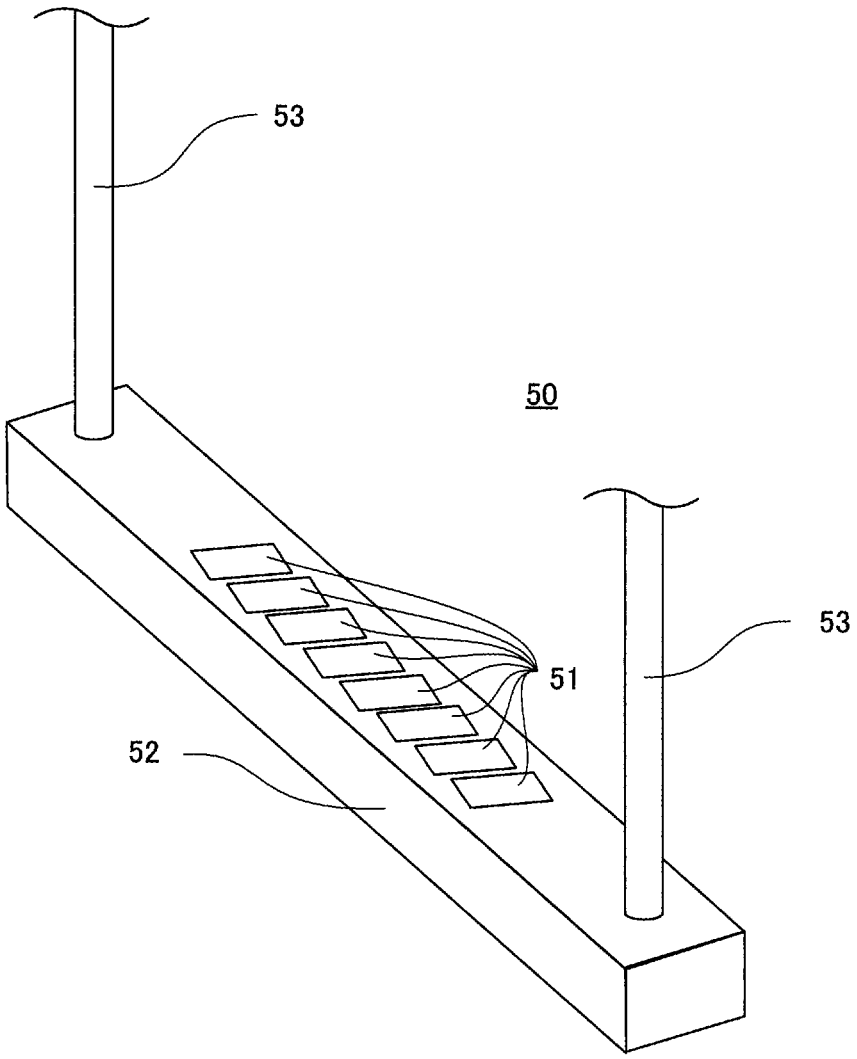
FIG. 9 PRIOR ART
FIG. 9 is a perspective view showing the structure of a line scan head in a conventional ink-jet apparatus.
Figure 10A:
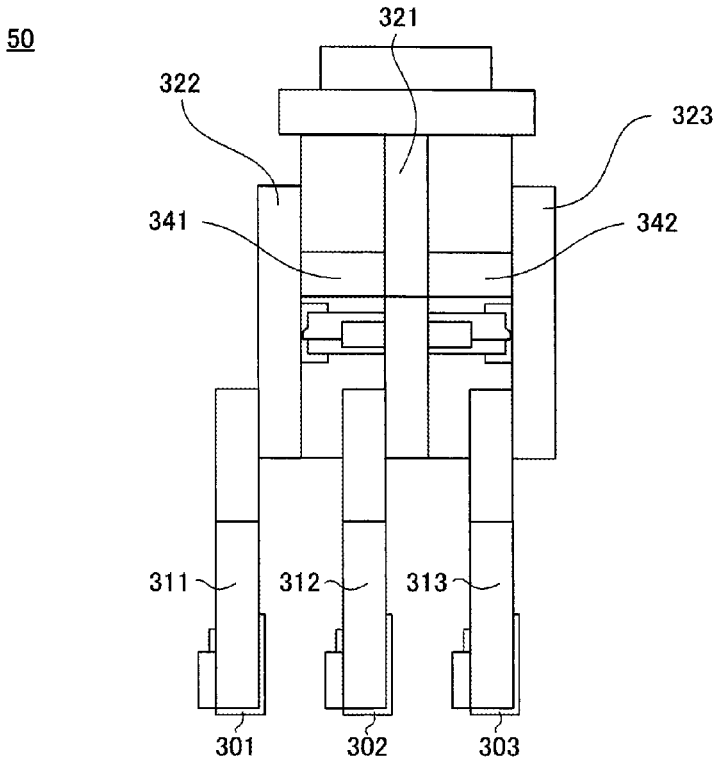
FIG. 10A PRIOR ART
FIG. 10(A) is a side view showing the structure of the line scan head in the conventional ink-jet apparatus.
Figure 10B:
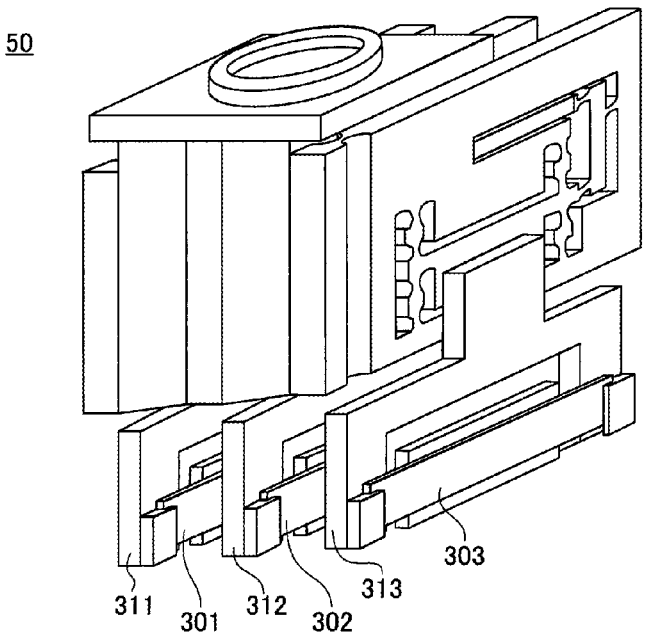
FIG. 10B PRIOR ART
FIG. 10(B) is a perspective view showing the structure of the line scan head in the conventional ink-jet apparatus.

For explanation, FIG. 1(A) shows a state in which the three ink-jet heads 201, 202, and 203 are mounted. Actually, as shown in FIG. 9, the multiple ink-jet heads 51 are sequentially arranged as in the state of FIG. 1(A). In this case, in FIG. 1(A), the vertical direction along the Y-axis direction is the print-scan direction during printing while the array direction of the ink-jet heads 201, 202, and 203 is the X-axis direction orthogonal to the print-scan direction.

In this configuration, the head plate 101 and the ink-jet head 203 are brought into contact and joined with each other in a junction region 120.

Figure 1B:
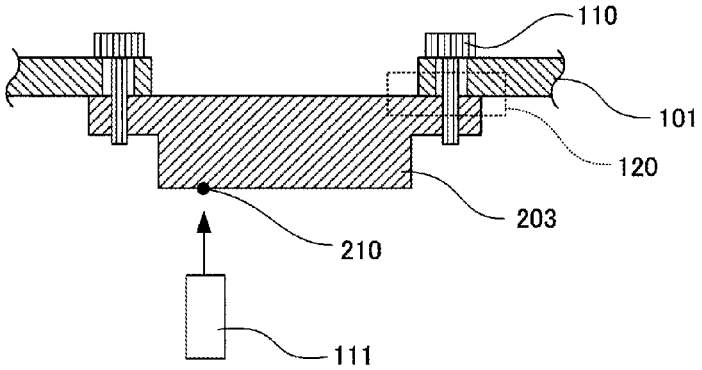
FIG. 1(B) is a schematic diagram showing one side of a part of a line scan head in the ink-jet apparatus according to the first embodiment.

FIG. 1(B) is a schematic diagram showing a cross section of a part taken along the line a-a' of FIG. 1(A). In FIG. 1(B), the ink-jet head 203 is temporarily fixed to the head plate 101 by screws 110 serving as fixing members.

As shown in FIG. 1(B), the ink-jet head 203 is slightly moved to a design location and is positioned thereon such that a nozzle 210 confirmed by a microscope 111 is aligned with desired coordinates. The position of the ink-jet head 203 is then fixed by fastening the screws 110. At this point, the allocation of error for the ink-jet heads is within ±2 μm, requiring extremely high precision.

Figure 2:
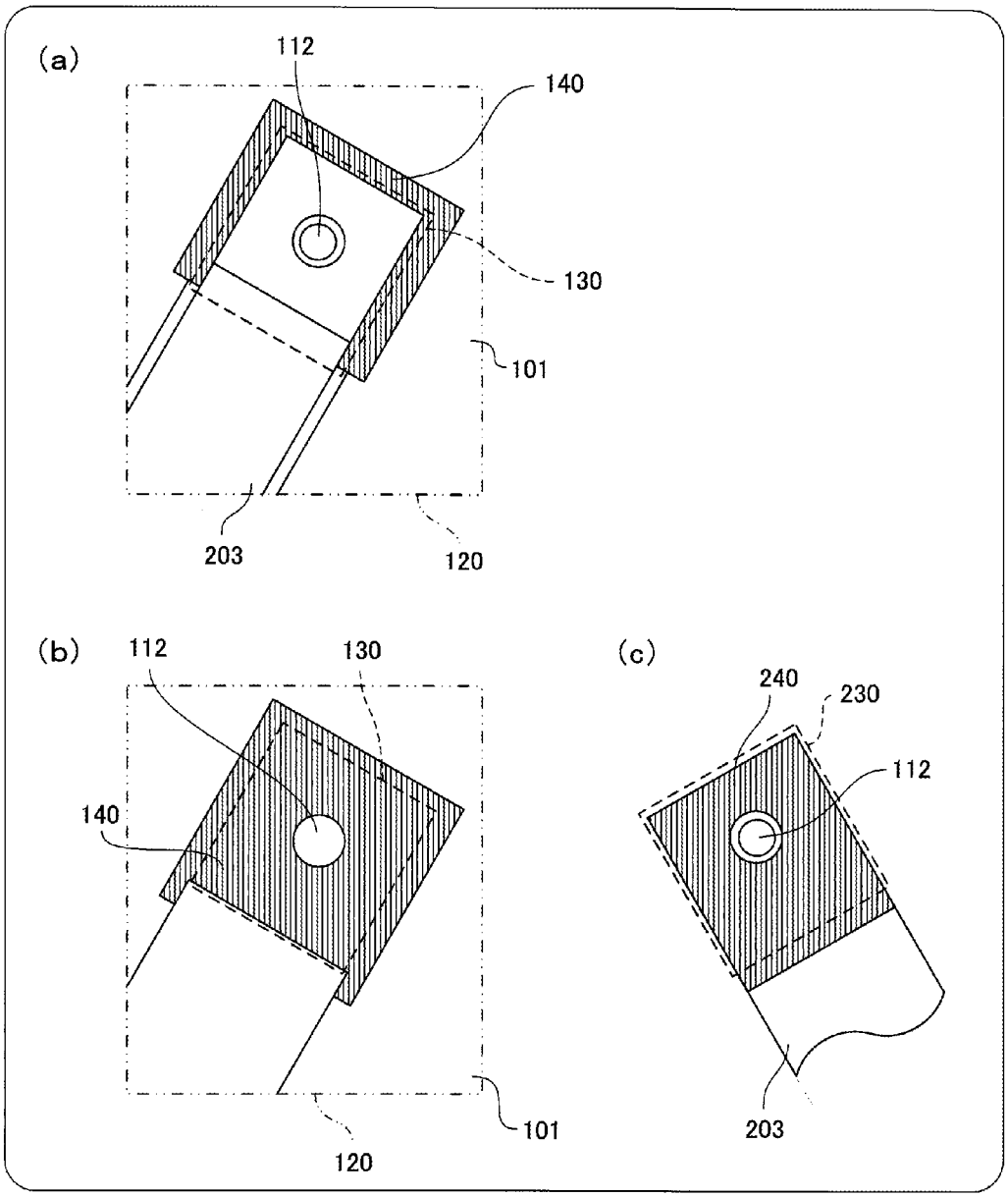
FIG. 2(A) is a schematic diagram showing the enlarged faying surface of the head plate in the ink-jet apparatus according to an example of the first embodiment.
FIG. 2(B) is a schematic diagram showing the enlarged faying surface of the head plate in the ink-jet apparatus according to the example of the first embodiment.
FIG. 2(C) is a schematic diagram showing the enlarged faying surface of the ink-jet head in the ink-jet apparatus according to the example of the first embodiment.

FIG. 2(A) is an enlarged schematic diagram of the junction region 120 shown in FIG. 1(A). In FIG. 2(A), a region indicated by a broken line is a faying surface 130 where the head plate 101 and the ink-jet head 203 are in contact with each other.

FIG. 2(A) is a top view of the ink-jet head 203 mounted on the head plate 101. For simplification, the fastening screws are omitted. Reference numeral 112 in FIG. 2(A) denotes a screw hole.

FIG. 2(B) shows a state in which the ink-jet head 203 is detached from the faying surface 130 of the head plate 101 shown in FIG. 2(A). FIG. 2(C) shows a faying surface 230 on the ink-jet head 203.

In FIG. 2(B), a region indicated by a broken line is a part where the head plate 101 is in contact with the ink-jet head 203 in FIG. 2(A), that is, the faying surface 130.

In FIG. 2(C), a region indicated by a broken line is a part where the ink-jet head 203 is in contact with the head plate 101 in FIG. 2(A), that is, the faying surface 230.

In this configuration, uneven portions 140 and 240 are formed on the faying surface 230 of the ink-jet head 203 in FIG. 2(C) and the faying surface 130 of the head plate 101 in FIG. 2(B).

The uneven portions 140 and 240 are formed like lines (grooves) substantially in parallel with the print-scan direction of a apparatus by a predetermined device beforehand. The uneven portions 140 and 240 are linearly formed so as to extend in the print-scan direction. In this case, the uneven portions 140 and 240 are desirably formed so as to contain the regions of the faying surfaces 130 and 230. In this example, the uneven portion 140 on the head plate 101 is formed in a region larger than the faying surfaces 130 and 230.

Thus, for simplification of a machining process, the facing surfaces of the head plate 101 and the ink-jet head 203 can be entirely machined without specifying regions.

The uneven portions are preferably formed by, for example, grinding with a grindstone and machining with a metallic brush. Chemical polishing such as acid etching may be used for the ink-jet head 203 and the head plate 101 as long as predetermined irregularities are formed.

Figure 3:
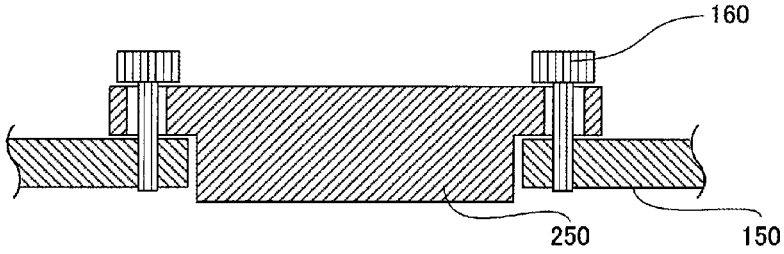
FIG. 3 shows another example of the relationship between the ink-jet head and the head plate in the ink-jet apparatus according to the first embodiment.

FIG. 3 shows another example of the relationship between the ink-jet head 203 and the head plate 101. In FIG. 3, an ink-jet head 250 is suspended on a head plate 150 and is screwed with screws 160. Also in this case, an uneven portion can be provided on a portion in contact with a junction region.

The screw hole 112 is located at the center of the faying surface 130 to evenly apply a force with the screw 110 in a lateral direction and a longitudinal direction.

Figure 4:
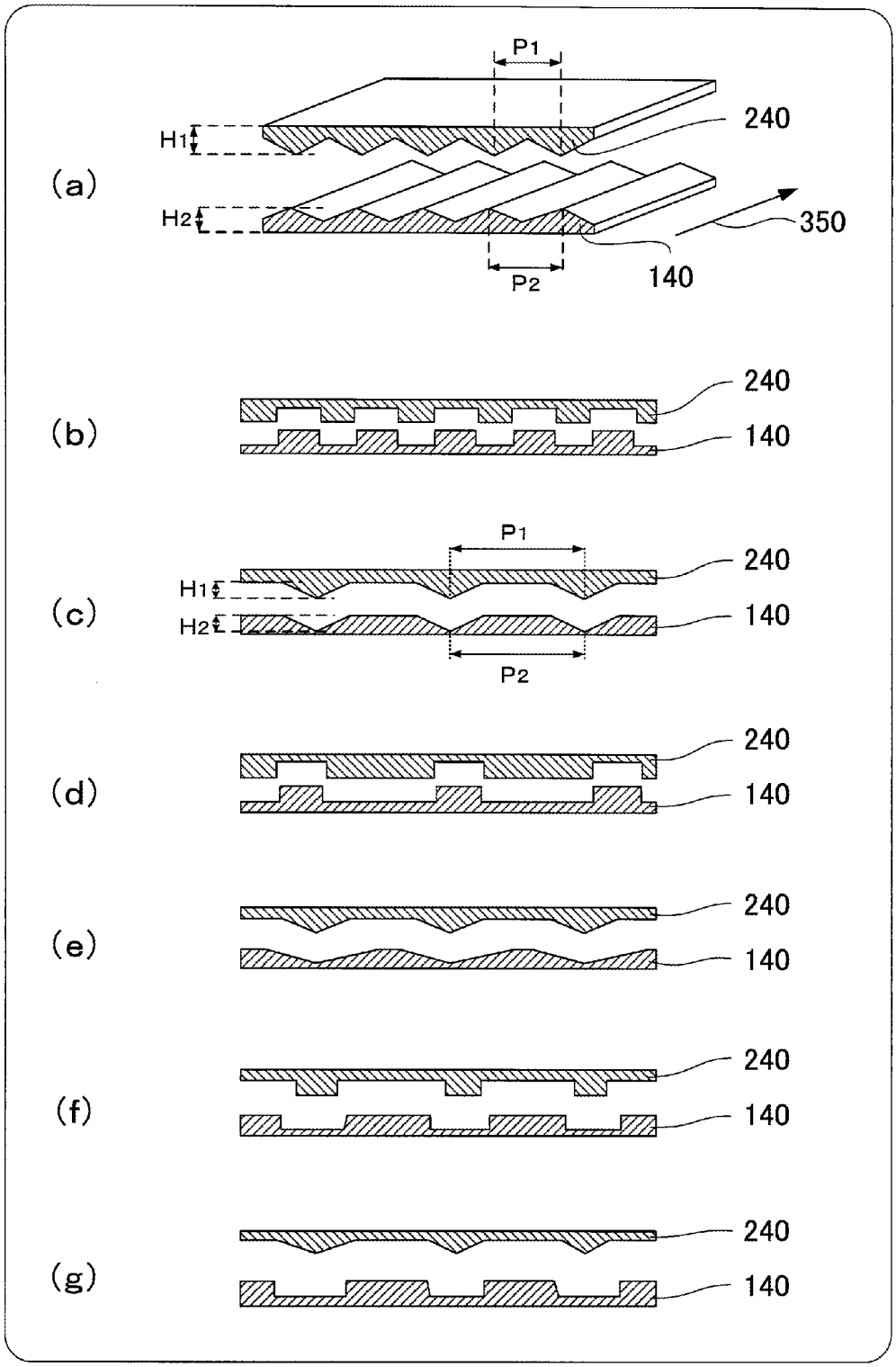
FIG. 4(A) is a partial perspective view showing the shape of uneven portions in the ink-jet apparatus according to the first embodiment.
FIGS. 4(B) to 4(G) are cross-sectional views showing modifications of the shape of uneven portions in the ink-jet apparatus.

The uneven portions 140 and 240 will be examined below. FIG. 4(A) shows an example of the uneven portions. FIG. 4(A) is a perspective view showing a part of the uneven portions 140 and 240 immediately before the uneven portions are joined to each other. The uneven portions are repeated with the same width.

The uneven portions 140 and 240 are identical in shape and triangular in cross section. The vertex of the uneven portion may be rounded or flattened (trapezoid). The uneven portions may be engaged with each other. The uneven portion 240 has a peak height H1 that is equal to a peak height H2 of the uneven portion 140. The uneven portion 240 has a pitch P1 that is equal to a pitch P2 of the uneven portion 140. The conditions of the uneven portions shaped thus are determined below.

The line direction of the uneven portions 140 and 240 may be in parallel with the print-scan direction or may be inclined by an angle α with respect to the print-scan direction (FIG. 1(A)).

EXAMPLE

The Line Direction of the Uneven Portion

Figure 5:
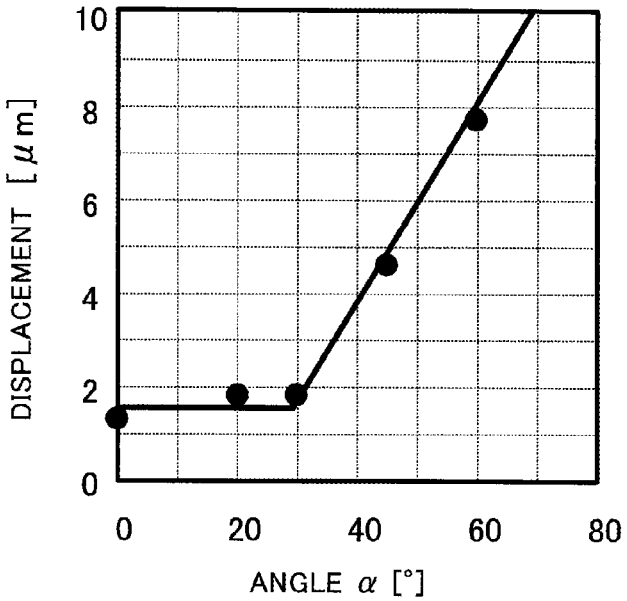
FIG. 5 is a graph showing the relationship between an angle $\alpha$ formed by a line direction and a print-scan direction and a displacement from an initial position in a direction orthogonal to the print-scan direction.

FIG. 5 is a graph showing the relationship between the angle α formed by a line direction 350 of the uneven portions 140 and 240 and the print-scan direction and a displacement from an initial position in the direction orthogonal to the print-scan direction (X-axis direction, hereinafter will be called a sub scanning direction). The displacement is caused by a temperature change or stress relaxation after the screws of the ink-jet head 203 are fastened.

The angle α with respect to the print-scan direction is formed by coordinates in the print-scan direction and the line direction 350 of the uneven portions in FIG. 1(A).

Figure 1C:
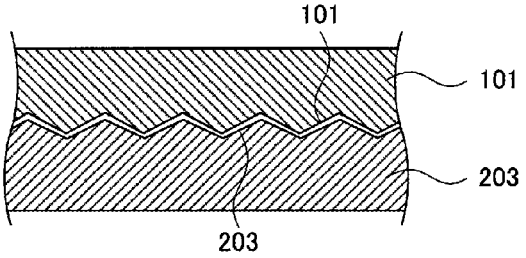
FIG. 1(C) is a cross-sectional schematic diagram showing the enlarged faying surfaces of a head plate and an ink-jet head in the ink-jet apparatus according to the first embodiment.

As shown in FIGS. 1 and 5, if the angle α is 30° or less, a displacement caused by stress relaxation of the ink-jet head can satisfy the range of ±2 μm that is a required allocation of error. If the angle α exceeds 30°, however, a displacement caused by the stress relaxation of the ink-jet head rapidly increases (critical phenomenon). This is because an effect recognized in this phenomenon guides a displacement along the print-scan direction until the angle α reaches 30°, and if the angle α exceeds 30°, a movement increases in the sub scanning direction orthogonal to the print-scan direction.

It is understood that the angle α is an important factor for suppressing a displacement. Thus, the line direction 350 of the uneven portions 140 and 240 is desirably extended in parallel with the print-scan direction. In other words, the angle α is preferably smaller. If the angle α is at least smaller than 30°, the effect of the present invention can be obtained.

In this case, the uneven portion 240 and the uneven portion 140 are respectively formed on the faying surface 230 of the ink-jet head 203 and the faying surface 130 of the head plate 101. The formation of roughness on at least one of the faying surface 230 and the faying surface 130 increases frictional resistance between the faying surfaces 130 and 230, suppressing a movement in the sub scanning direction orthogonal to the print-scan direction.

If the angle α with respect to the print-scan direction is smaller than 30°, the uneven portion 240 of the faying surface 230 and the uneven portion 140 of the faying surface 130 do not always need to be formed in the same direction.

<Pitch P of the Uneven Portion>

Figure 6:
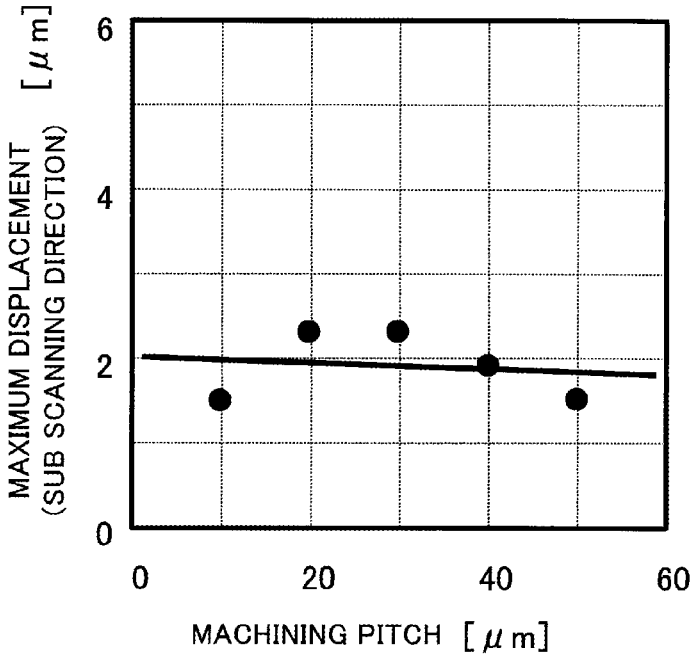
FIG. 6 is a graph showing the relationship between a roughness machining pitch and a displacement in the direction orthogonal to the print-scan direction.

The pitches of the machined uneven portions 140 and 240 will be described below. FIG. 6 is a graph showing the relationship between a roughness machining pitch and a displacement in the sub scanning direction orthogonal to the print-scan direction. In this case, the uneven portion has a height H of 0.5 μm.

As shown in FIG. 6, an increase in machining pitch only slightly changes a displacement in the sub scanning direction orthogonal to the print-scan direction, so that a machining pitch and a displacement in the sub scanning direction orthogonal to the print-scan direction substantially change in a linear form. Thus, the machining pitch does not need to be limited as long as the faying surface 130 is machined into an uneven surface. A pitch of 50 μm or less does not cause any problems.

<Height H of the Uneven Portion>

Figure 7:
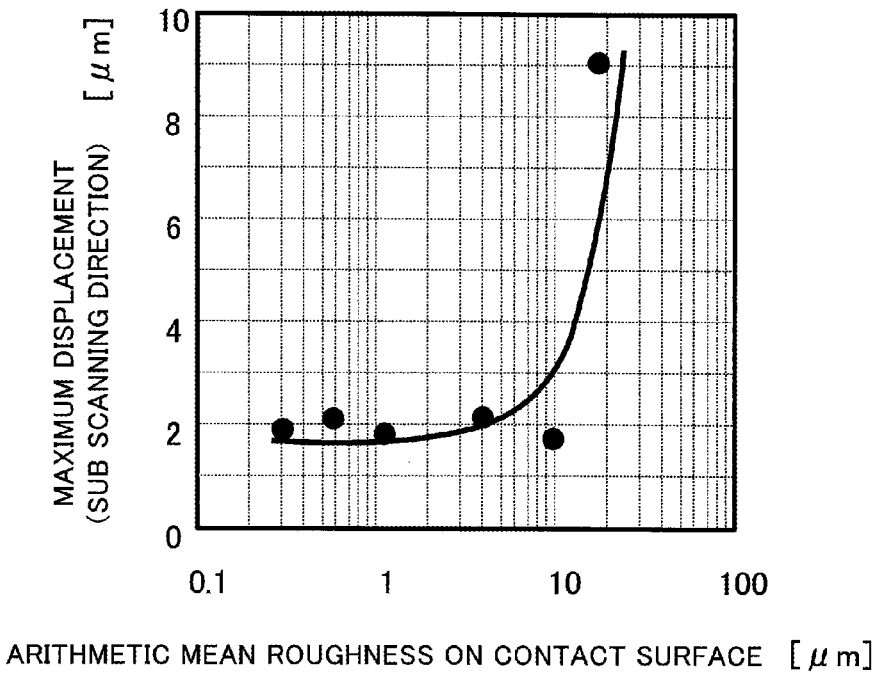
FIG. 7 is a graph showing the relationship between the mean roughness of the uneven portion and a displacement in the direction orthogonal to the print-scan direction.
Figure 8:
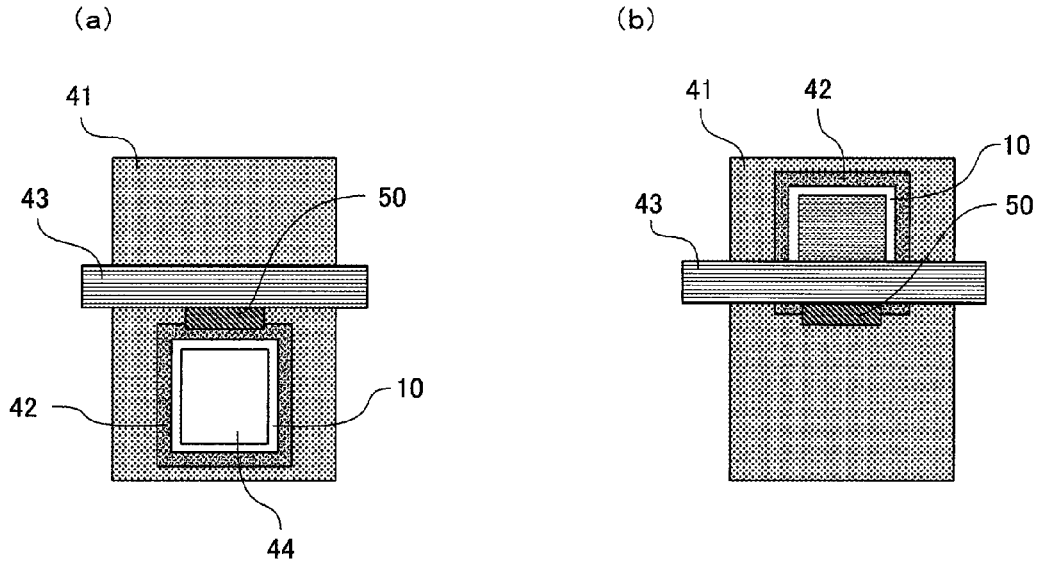
FIG. 8(A) is a schematic diagram showing a state before a printing operation of the ink-jet apparatus.
FIG. 8(B) is a schematic diagram showing a state after the printing operation of the ink-jet apparatus.

The height of the machined uneven portion (a peak height and a bottom depth) will be described below. FIG. 7 is a graph showing the relationship between the arithmetic mean roughness of the formed uneven portion and a displacement in the sub scanning direction orthogonal to the print-scan direction. At this point, the uneven portion is machined with a 10-μm pitch.

As shown in FIG. 7, a displacement in the direction orthogonal to the print-scan direction increases with arithmetic mean roughness. The displacement considerably increases particularly in a region where the arithmetic mean roughness exceeds 10 μm (critical phenomenon). This is because surface roughness on the faying surfaces 130 and 230 does not lead to resistance against a moving stress in the sub scanning direction orthogonal to the print-scan direction and rapidly increases a movement over the uneven portion. Hence, the arithmetic mean roughness of the faying surface needs to be set at 10 μm or less.

In FIG. 4(A), the uneven portions are triangular in cross section. The shape of the uneven portion is not particularly limited. Alternatively, the uneven portions 140 and 240 may not be identical in shape as will be examined below:

FIG. 4(B) is a cross-sectional view of the uneven portions 140 and 240. In FIG. 4(B), the uneven portions are rectangular in cross section. In this case, for the engagement of the uneven portions 140 and 240, a concave needs to be larger in width than a convex.

The uneven portions 140 and 240 in FIGS. 4(C) to 4(G) vary in shape unlike in FIGS. 4(A) and 4(B). Specifically, in FIGS. 4(C) to 4(G), the uneven portions 140 and 240 do not both have convexes and concaves. One of the uneven portions 140 and 240 has concaves while the other uneven portion has convexes.

FIG. 4(C) is a cross-sectional view of the uneven portions 140 and 240. The uneven portion 240 has convexes that are triangular in cross section while the uneven portion 140 has concaves that are triangular in cross section. The convexes and the concaves are engaged with each other. As in FIG. 4(A), the vertexes of the triangles may be rounded or flattened (trapezoid).

FIG. 4(D) is a cross-sectional view of the uneven portions 140 and 240. The uneven portion 240 has convexes that are rectangular in cross section while the uneven portion 140 has concaves that are rectangular in cross section. The convexes and the concaves are engaged with each other. As in FIG. 4(B), for the engagement of the concaves and the convexes, the concave needs to be larger in width than the convex.

FIG. 4(E) shows a modification of FIG. 4(C). FIG. 4(E) is different from FIG. 4(C) in the cross-sectional shape of the uneven portion 140 and the cross-sectional shape of the uneven portion 240. Specifically, in FIG. 4(E), the triangular concave of the uneven portion 140 in cross section has a larger spread angle than that of the triangular convex of the uneven portion 240 in cross section. Thus, the uneven portions 140 and 240 are easily engaged with each other.

FIG. 4(F) is a modification of FIG. 4(D). FIG. 4(F) is different from FIG. 4(D) in the cross-sectional shape of the uneven portion 140 and the cross-sectional shape of the uneven portion 240. Specifically, in FIG. 4(F), the rectangular concave of the uneven portion 140 in cross section is larger in width than the rectangular convex of the uneven portion 240 in cross section. Thus, the uneven portions 140 and 240 are easily engaged with each other.

In FIG. 4(G), the cross-sectional shape of the uneven portion 140 having concaves is considerably different from that of the uneven portion 240 having convexes. The uneven portion 240 having the triangular convexes in cross section and the uneven portion 140 having the rectangular concaves in cross section are easily engaged with each other. The uneven portion 240 having the convexes needs to be fit into the uneven portion 140 having the concaves.

In FIGS. 4(C) to 4(G), the shapes of the uneven portion 140 and the uneven portion 240 may be changed with each other.

Also in FIGS. 4(B) to 4(G), as in FIG. 4(A), the pitch P of the convexes may be 50 μm or less and the height H of the convexes may be 10 μm or less.

(Summary)

In installation of ink-jet heads constituting a line scan head, a stress is concentrated on the ink-jet heads and the installation locations of the ink-jet heads by, for example, an external thermal stress and a stress reduced by unloading after positioning, resulting in a displacement. However, if a line scan head has a rough faying surface as in the present invention, a load generated on a fixing member causes the faying surface to act as a sliding surface having anisotropy.

Specifically, according to irregularities formed on a substrate in a print-scan direction, the coordinates of the irregularities move in the print-scan direction. Conversely, a possible displacement can be minimized in a sub scanning direction orthogonal to the print-scan direction. A possible displacement is positively guided in the print-scan direction, minimizing the influence in the sub scanning direction orthogonal to the print-scan direction so as to relax a generated stress.

A displacement in the print-scan direction can be easily corrected by adjusting timing for discharging ink droplets from the ink-jet heads during scanning. This can keep the accuracy of printing without causing any problems in production.

The ink-jet apparatus of the present invention is applicable to a light-emitting material of an organic electroluminescence device, a hole transport layer, printing of an electron transport layer, printing of a color filter, and so on.

What is claimed is:

1. An ink-jet apparatus comprising a plurality of ink-jet heads, a plate loaded with the ink-jet heads, and a fixing member that fixes the ink-jet heads and the plate, wherein the plate and the ink-jet head have faying surfaces, one faying surface has a plurality of long thin concaves, the other faying surface has a plurality of long thin convexes entered into at least one of the long thin concaves, and the width of a region containing the long thin concaves in a direction orthogonal to the length direction of the long thin concaves is not smaller than the width of a region containing the long thin convexes on the faying surfaces in a direction orthogonal to the length direction of the long thin convexes.

2. The ink-jet apparatus according to claim 1, wherein the fixing member is positioned on at least a part of the faying surface.

3. The ink-jet apparatus according to claim 1, wherein the length direction of the long thin convexes and a print-scan direction of a substrate form an angle of 30° or less.

4. The ink-jet apparatus according to claim 1, wherein the long thin convexes have mean surface roughness of 10 μm or less and the long thin concaves have mean surface roughness of 10 μm or less.

5. The ink-jet apparatus according to claim 1, wherein the long thin convexes have a pitch of 50 μm or less and the long thin concaves have a pitch of 50 μm or less.

6. The ink-jet apparatus according to claim 1, wherein the plate contains the faying surface, and at least the long thin convexes or the long thin concaves are formed around the faying surface.

7. The ink-jet apparatus according to claim 1, wherein the long thin convexes and the long thin concaves are extended with an identical pitch in an identical line direction.

8. The ink-jet apparatus according to claim 1, wherein the long thin convexes include long thin concaves or the long thin concaves include long thin convexes.

* * * * *

UNITED STATES PATENT AND TRADEMARK OFFICE

CERTIFICATE OF CORRECTION

PATENT NO. : 8,979,248 B2
APPLICATION NO. : 14/337838
DATED : March 17, 2015
INVENTOR(S) : Yamamoto et al.

It is certified that error appears in the above-identified patent and that said Letters Patent is hereby corrected as shown below:

Title page, add:

(30) Foreign Application Priority Data

Jul. 22, 2013 (JP) ..... 2013-151403

Signed and Sealed this
Thirteenth Day of October, 2015

Michelle K. Lee

Michelle K. Lee
*Director of the United States Patent and Trademark Office*